US009743690B2

(12) United States Patent
Zeier

(10) Patent No.: US 9,743,690 B2
(45) Date of Patent: Aug. 29, 2017

(54) RESEALABLE PACKAGING MADE OF PAPER, CARDBOARD OR PAPERBOARD, ESPECIALLY FOR RECEIVING SHEETS AND PAPER

(71) Applicant: ZECASO GmbH, Zurich (CH)

(72) Inventor: Urs Zeier, Zurich (CH)

(73) Assignee: ZECASO GmbH, Zurich (CH)

( * ) Notice: Subject to any disclaimer, the term of this patent is extended or adjusted under 35 U.S.C. 154(b) by 0 days.

(21) Appl. No.: 14/375,873

(22) PCT Filed: Jan. 31, 2013

(86) PCT No.: PCT/IB2013/050817
§ 371 (c)(1),
(2) Date: Jul. 31, 2014

(87) PCT Pub. No.: WO2013/114309
PCT Pub. Date: Aug. 8, 2013

(65) Prior Publication Data

US 2015/0014193 A1 Jan. 15, 2015

(30) Foreign Application Priority Data

Jan. 31, 2012 (DE) ..... 10 2012 100 761

(51) Int. Cl.
*A24F 17/00* (2006.01)
*B65D 83/08* (2006.01)

(52) U.S. Cl.
CPC ..... *A24F 17/00* (2013.01); *B65D 83/0805* (2013.01)

(58) Field of Classification Search
CPC ..... B65D 27/20; B65D 45/22; B65D 75/18; B65D 75/14; B65D 43/22; B65D 43/18; B65D 43/16; B65D 43/162; B65D 77/006; B65D 77/003; B65D 77/14; B65D 77/20;
(Continued)

(56) References Cited

U.S. PATENT DOCUMENTS 864,648 A * 8/1907 Jaeger ..... B65D 77/006 206/472
996,968 A 7/1911 Broussaud
1,177,736 A 4/1916 Thomas
(Continued)

FOREIGN PATENT DOCUMENTS

AT 514312 B1 2/2015
AU 2010200516 A1 9/2010
(Continued)

OTHER PUBLICATIONS

International Search Report (in English) for PCT/IB2013/050817 issued Jun. 24, 2013.
(Continued)

*Primary Examiner* — Anthony Stashick
*Assistant Examiner* — James Way
(74) *Attorney, Agent, or Firm* — Jason H. Vick; Sheridan Ross, PC

(57) ABSTRACT

The invention relates to a packaging with a base body, that includes a compartment, and a closing flap. The closing flap includes a substantially shape-retaining, bent end area that is dimensioned and configured such that the end area reaches at least partially around a front surface of the base body in the closed state of the packaging.

22 Claims, 10 Drawing Sheets

(58) Field of Classification Search
CPC ... B65D 3/20; B65D 3/10; B65D 3/26; B65D 3/268; B65D 3/00; A47F 17/00
See application file for complete search history.

(56) References Cited

U.S. PATENT DOCUMENTS

| | | | | |
|---|---|---|---|---|
| 1,511,107 | A | 10/1924 | Chambon | |
| 1,902,699 | A | 3/1933 | Gerjets | |
| 2,559,320 | A | 7/1951 | Rushing et al. | |
| 3,371,848 | A * | 3/1968 | Ward | B65D 77/20 220/270 |
| 3,465,947 | A * | 9/1969 | Westman | B65D 85/324 206/521.1 |
| 3,531,044 | A * | 9/1970 | Baker | B65D 85/324 206/521.4 |
| 3,563,450 | A * | 2/1971 | Dahlberg | B65D 85/324 206/521.1 |
| 3,968,880 | A | 7/1976 | Ostrowsky | |
| 4,114,629 | A | 9/1978 | Sedlacek et al. | |
| 4,133,449 | A | 1/1979 | Ostrowsky | |
| 5,158,205 | A * | 10/1992 | Bodziak | B65D 83/0805 221/305 |
| D334,404 | S | 3/1993 | Ostrowski | |
| 5,385,255 | A * | 1/1995 | Varano | B65D 43/0212 220/380 |
| 5,518,144 | A * | 5/1996 | Samuelson | B42D 5/003 221/33 |
| D411,767 | S | 7/1999 | Keller | |
| 5,927,501 | A * | 7/1999 | Herbruck | B65D 81/3294 206/521.8 |
| 5,996,797 | A * | 12/1999 | Flaig | B65D 77/02 206/210 |
| 6,170,655 | B1 | 1/2001 | Hill | |
| D529,086 | S | 9/2006 | Wehmeyer | |
| D575,347 | S | 8/2008 | Fedon | |
| 7,611,014 | B2 * | 11/2009 | Bobe | B65D 83/0805 206/233 |
| 2003/0121803 | A1 | 7/2003 | Banks et al. | |
| 2004/0144660 | A1 | 7/2004 | Staiano | |
| 2004/0200852 | A1 | 10/2004 | Allison et al. | |
| 2008/0302683 | A1 | 12/2008 | Tanzer | |
| 2009/0127148 | A1 | 5/2009 | Pratis Palazzo | |
| 2009/0266725 | A1 | 10/2009 | Villarinho et al. | |
| 2010/0059538 | A1 * | 3/2010 | Van De Perre | A24F 17/00 221/34 |
| 2010/0206757 | A1 | 8/2010 | Kesselman | |
| 2010/0270303 | A1 | 10/2010 | Kesselman et al. | |
| 2011/0030710 | A1 | 2/2011 | Kesselman | |
| 2012/0103842 | A1 | 5/2012 | Koester | |
| 2012/0193388 | A1 * | 8/2012 | Machota | A24F 17/00 225/39 |

FOREIGN PATENT DOCUMENTS

| | | | |
|---|---|---|---|
| BE | 441335 | | 6/1941 |
| BE | 504239 | | 10/1951 |
| BE | 905803 | | 3/1987 |
| CA | 2535339 | A1 | 6/2007 |
| CH | 139726 | | 4/2013 |
| CH | 139743 | | 4/2013 |
| CN | 201161739 | Y | 12/2008 |
| CN | 101341076 | A | 1/2009 |
| DE | 810374 | | 7/1949 |
| DE | 9010917.1 | | 1/1991 |
| DE | 4023380 | A1 | 1/1992 |
| DE | 29502062 | U1 | 6/1996 |
| DE | 29803859 | U1 | 8/1998 |
| DE | 20104326 | U1 | 6/2001 |
| DE | 20220666 | U1 | 1/2004 |
| DE | 20317744 | | 4/2004 |
| DE | 20317744 | U1 | 5/2004 |
| DE | 10349190 | A1 | 5/2005 |
| DE | 202004019112 | U1 | 5/2006 |
| DE | 202005009686 | U1 | 11/2006 |
| DE | 102009025882 | A1 | 12/2010 |
| DE | 102011051280 | B3 | 7/2012 |
| DE | 102011051281 | B3 | 7/2012 |
| DE | 102012100802 | A1 | 8/2013 |
| EP | 1155974 | A1 | 11/2001 |
| EP | 1378182 | A1 | 1/2004 |
| EP | 1382264 | A1 | 1/2004 |
| EP | 1913826 | A1 | 4/2008 |
| EP | 1961317 | A1 | 8/2008 |
| EP | 2002739 | A1 | 12/2008 |
| EP | 2016841 | A2 | 1/2009 |
| FR | 389620 | | 12/1908 |
| FR | 393986 | | 1/1909 |
| FR | 401062 | | 8/1909 |
| FR | 471311 | | 10/1914 |
| FR | 511233 | | 12/1920 |
| FR | 512989 | | 2/1921 |
| FR | 631827 | | 12/1927 |
| FR | 764082 | | 5/1934 |
| FR | 786639 | | 9/1935 |
| FR | 786639 | | 3/1937 |
| FR | 1007699 | | 5/1952 |
| FR | 1085585 | | 2/1955 |
| FR | 2593033 | | 7/1987 |
| FR | 2767033 | | 2/1999 |
| FR | 2814340 | | 3/2002 |
| FR | 2821526 | | 9/2002 |
| FR | 2827742 | | 1/2003 |
| FR | 2876252 | | 4/2006 |
| GB | 198911622 | A | 7/1898 |
| GB | 191126008 | | 3/1912 |
| GB | 700779 | | 12/1953 |
| GB | 1305739 | | 2/1973 |
| GB | 2435881 | B | 2/2011 |
| JP | H06 293378 | | 10/1994 |
| JP | H 06293378 | | 10/1994 |
| NL | 1004240 | C | 4/1998 |
| WO | WO 01/11995 | A1 | 2/2001 |
| WO | WO 2004/056661 | A2 | 7/2004 |
| WO | WO 2006/111956 | A2 | 10/2006 |
| WO | WO 2009/013111 | A1 | 1/2009 |
| WO | WO 2009/020383 | A1 | 2/2009 |
| WO | WO 2010/133741 | | 11/2010 |
| WO | WO 2010/144063 | A1 | 12/2010 |
| WO | WO 2012/176147 | A2 | 12/2012 |
| WO | WO 2012/176148 | A2 | 12/2012 |
| WO | WO 2013/114312 | A2 | 8/2013 |
| WO | WO DM/084255 | | 3/2014 |

OTHER PUBLICATIONS

Written Opinion (in English) for PCT/IB2013/050817 issued Jul. 31, 2014.
U.S. Appl. No. 29/484,373, filed Mar. 8, 2014.
U.S. Appl. No. 29/484,375, filed Mar. 8, 2014.

* cited by examiner

RESEALABLE PACKAGING MADE OF PAPER, CARDBOARD OR PAPERBOARD, ESPECIALLY FOR RECEIVING SHEETS AND PAPER

CROSS-REFERENCE TO RELATED APPLICATIONS

This application is a National Stage application of International Application No. PCT/IB2013/050817, filed on Jan. 31, 2013, which claims priority of German patent application number 10 2012 100 761.6, filed on Jan. 31, 2012, both of which are incorporated herein by reference in their entireties.

BACKGROUND

Field of the Invention

The present invention is related to a packaging with a base body, that comprises a compartment, and a closing flap.

Related Art

The following explanations primarily refer to a packaging for cigarette sheath paper sheets and/or cigarette filter paper sheets, because the innovative idea can be illustrated very well here. However, it is explicitly pointed out that this invention also relates to the packaging for other types of papers and documents, especially regarding sticky notes, which for example the company 3M is currently marketing under the brand Post-it® notes or Post-it® Z-notes, as well as for sticky stripes or marking flags, which for example the company 3M is currently marketing under the brand Post-it® Index or Post-it® Page Marker. Furthermore handkerchiefs shall particularly be understood as paper, too.

Such packaging is known from GB 2 121 000 A. The packaging shown comprises a cardboard with a cutout in the front wall and a lid with a closing flap. The closing flap is located behind the cutout in the front wall, and if the closing flap is closed it is parallel to the front wall. A continuous roll of cigarette paper is inserted inside the cardboard, and with its free ends it's positioned between the front wall and the closing flap and visible through the cutout of the packaging. Through the cutout of the packaging the consumer can now move the paper out of the packaging by using a finger or thumb. If the required length of protruding paper is according to the length of paper needed for the making of a cigarette, then the consumer can rip off the protruding strip of paper along the upper edge of the front wall.

Although the mentioned solution above can be used as packaging, the size of the packaging leaves a lot to be desired. The cigarette paper tape is wound onto a cardboard roll and housed with enough space inside the packaging so that a sticking or deadlock is prevented. The thus oversized packaging equates to a multiple of the volume of the packaged cigarette paper. The angled packaging is oversized to such an extent that it can be felt as disturbing while being carried around in a pocket. Because of the cutout provided for transmitting the force, the packaging is not optimally protected against moisture either. If the end of the cigarette paper near the cutout becomes wet or moist, it causes the paper of the packaging to stick down and the paper can now no longer be removed.

Further, a cigarette paper dispenser for storing and providing cigarette paper sheets for the self-making of cigarettes is shown in DE 203 17 744 U1. A slit from where the cigarette paper sheets can be removed, will be closed by a closing flap, wherein the closing flap, when closed, is held by glue, a Velcro fastener, a magnetic catch or by insertion into a slit.

The mentioned documents are just a couple of many examples of packagings that receive cigarette sheath paper sheets, cigarette filter paper sheets or both. Such packagings target tobacco consumers that desire to make their cigarettes on their own. The goal of such packaging is to provide the tobacco consumers with at least some of the parts needed for the production of a self-made cigarette in a handy and protected way.

Although it is desired to give the consumer a uniquely useful and appealing packaging, the cost aspects still have a considerable influence on the design of such a packaging. The packagings known today present a situation as follows: Packaging which are cheap to produce, have no or only little appeal regarding their visual appearance and their handling. Packagings that are visually appealing and/or appealing in their handling are too expensive for cigarette paper.

SUMMARY OF THE INVENTION

Therefore, it is an object of the invention, to provide an improved packaging, particularly for receiving cigarette sheath paper sheets or cigarette filter paper sheets or sticky notes or sticky stripes, especially for a combined accommodation of cigarette sheath paper sheets and cigarette filter paper sheets or a combined accommodation of sticky notes and sticky stripes that overcome the disadvantages mentioned above.

The object is achieved by a packaging described above, in which the closing flap comprises a substantially shape-retaining, bent end area that is dimensioned and configured such that the end area reaches at least partially around a front surface of the base body in the closed state of the packaging, wherein the closing flap is configured with the end area such that when opening or closing the packaging the end area can be pushed over the front surface against an elastic counter force by tensioning the closing flap in a direction of the longitudinal extension around the base body or wherein the closing flap is configured with the end area such that when opening or closing the packaging the end area can be pushed over the front surface undergoing a slight deflection.

One noteworthy aspect of the invention is that the closing flap has a substantially shape-retaining, bent end area. The term "substantially shape-retaining" means, that the end area, while in normal use of the packaging, substantially won't change its form or after application of a force, for example a lengthening or compression, will return to its original shape. With other words, if a change in shape takes place, then only against a counter force, which moves the end area back into its original shape when the application of the force ends.

Some of the preferred embodiments the shape-retaining effect is not limited to of the end area but continues in an area of the closing flap, that is adjacent to the end area. This adjoining area has a shape-retaining effect as well, but which may be less than the one of the end area. A change in shape of the end area and/or the adjoining area can only take place against a counter force, which moves the end area back into its original shape when the application of the force ends.

Another noteworthy aspect of the invention is that the shape-retaining end area at least partially reaches around the end face of the base body. In the closed state the end area holds onto the mentioned end face due to its shape, in particular in a form-fitting manner, and prevents a loosening of the closing flap or an unintentional opening of the packaging.

One of the advantages of the invention is that there is no need for glue, Velcro or magnetic catches mentioned at the beginning. Also the insertion of flaps into a slit is not necessary anymore.

The closing flap is particularly provided as an extension from the base body in a longitudinal direction of the base body, when viewing the fully opened state. Furthermore it is preferred, that the closing flap is sized and configured such that it covers at least partially a first opening of the compartment. In particular, the closing flap shall cover at least 50% preferably at least 75% especially preferably 85% and in particular 95% of the opening. It is especially preferable when the closing flap covers the opening fully.

When the closing flap is open, access to the opening or openings of the compartment is possible. When the sealing flap is closed, the opening or the openings, respectively, of the compartment are covered and the content inside is protected. The front surface is preferably one of the front surfaces of the base body that is faced towards a plane that is spanned by a transverse extension and a vertical extension.

The bending of the end area can be achieved in different ways. In the simplest case the bending can be achieved by bending the end area along one or more bending edges. However, it is believed to be beneficial, when the bending of the end area is performed continuously, so that a kind of curvature is created.

In the context of the bending of the end area it is believed to be beneficial if the end area corresponds at least substantially to the contour of the front surface around which the end area reaches. This results in a good holding effect and stability when the packaging is in the closed state. It is noted that a direct contact between the end area and the front surface is not necessary. It is understood that the end area also reaches around the front surface if there is an additional layer between the end area and the front surface.

Further it is believed to be advantageous if the front surface which the end area reaches around has a curvature when viewed from the side, in particular in the shape of a U, a shape like half a circle or a shape like half an ellipse. This embodiment allows the end area to glide onto the curvature of the front surface when opening and/or closing the packaging. The packaging thus can be opened and/or closed easily.

The term cigarette sheath paper sheet or cigarette paper sheet or cigarette paper is intended to refer to the material that provides for the shape of the outer body of the cigarette. The expression cigarette filter paper sheet or cigarette filter paper or filter paper is intended to indicate, in the context of the present invention, the material that allows to produce by rolling a cylinder like filter for the cigarette. The filter is arranged at one end of the cigarette, wherein the remaining part of the cigarette is typically filled with tobacco.

In order to provide for an eased orientation, in the context of the present invention, terms like transverse extension, longitudinal extension, vertical extension, etc. are used. These terms are only used for an eased understanding of the invention in order to differentiate between different directions and dimensions. These terms, however have no limiting effect. In particular, the invention and the corresponding embodiments do not depend on a particular choice of names for these terms. Rather, different terms may be given to the different directions and dimensions as long as the use of these terms is applied in a consistent manner.

In order to define a system of orientation for explaining the invention, a transverse extension, a longitudinal extension and a vertical extension are defined for the base body. The transverse extension is chosen such that it is greater than or equal to the longitudinal extension. The longitudinal extension is chosen such that it is greater than the vertical extension.

In particular, for preferred embodiments of the invention, the transverse extension is at least 50% greater than the longitudinal extension, and the longitudinal extension is at least 50% greater than the vertical extension. For other embodiments, in particular such embodiments as shown in the exemplary embodiments, the transverse extension is at least twice the longitudinal extension, and the longitudinal extension is at least twice the vertical extension.

The opening and closing of the packaging can, depending on the particular embodiment, take place according to a first manner or according to a second manner or according to a first and second manner.

The first manner relates to the situation where, when opening or closing the packaging, the end area is pushed over the front surface against an elastic counter force by tensioning the closing flap in a direction of the longitudinal extension around the base body. This first manner benefits from the situation that the closing flap, even if only to a small degree, can be tensioned tighter against the base body. This possibility is for example not available when using a hinge. In this context, one or more bending areas and/or a particularly elongated closing flap are preferred. When the packaging is closed, the closing flap cannot get loose and the packaging cannot open up, as long as no specifically directed force is applied that allows to tension the closing flap and to lift the end area away from the front surface. This functional principle will be explained in more detail in the context of exemplary embodiments. In general, it is noted that the term pushing does not require a continuous contact with the front surface. Rather, for this and other embodiments the term "pushing" can also be understood in the sense of "lifting", so that the end area can be lifted over the front surface.

The second manner relates to a situation where, when opening or closing the packaging, the end area can be pushed over the front surface undergoing a slight deflection. This manner takes advantage of the situation that the end area is shape-retaining and that its shape can be changed at least slightly in connection with the closing flap and against a counter force. When the packaging is closed, the closing flap cannot get loose and the packaging cannot open up, unless a specifically directed force is applied which allows to push the end area undergoing a slight deflection over the front surface. This functional principle will be explained in more detail with reference to the exemplary embodiments. It is preferred in particular that the packaging allows for both manners described above for closing and opening, respectively, the packaging.

It is noted that according to some preferred embodiments the compartment is integrally formed with the base body as one piece. According to other preferred embodiments, the compartment is not formed integrally with the base body, but, in particular, may be inserted or glued into the base body. In the context of the present invention a compartment may be understood in particular in a sense that it has at least substantially a cuboid outer contour. The cuboid-shaped outer contour has a dispensing side with an opening, in particular a slit, for the dispensing or removal of cigarette sheath paper sheets or cigarette filter paper sheets and comprises three, preferably four and in particular five further sides which are at least substantially closed.

The desired objective is thus achieved.

According to a preferred refinement of the invention the packaging comprises exactly one compartment.

This embodiment is easy to implement, because it does not comprises an additional compartment beyond the exactly one compartment. However, it is possible to attach an additional product to the packaging, e.g., by gluing or inserting, whereby this product is also enclosed by the closing flap when the packaging is closed.

According to a further preferred refinement of the invention the end area comprises in its cross section along a longitudinal extension of the closing flap at least substantially a shape of a U, a shape of a half circle or a shape of a half ellipse, wherein the height of the cross section is greater than the width of the cross section.

This embodiment is especially advantageous if the front surface of the base body has a corresponding contour as has been explained above. When opening and/or closing the packaging the end area can glide particularly well onto the front surface. Due to the fact that the height of the cross section is greater than the width of the cross section, it is advantageously provided that during opening and/or closing of the packaging no blocking occurs when the end area glides onto the front surface.

According to a further preferred refinement of the invention the end area comprises an end edge and the end edge comprises a recess so that the end area does not reach around the front surface in the area of the recess.

This embodiment is advantageous because the packaging can be opened particularly easily. The recess is preferably arranged such that the middle of the recess divides the end area along its transverse extension in a ratio between 1:1.1 and 1:10, preferably between 1:3 and 1:6.5, more preferably between 1:1.4 and 1:3.4 and in particular between 1:1.7 and 1:2.7.

According to a further preferred refinement, the end area comprises an end edge which runs along the transverse extension and establishes the end of the closing flap, wherein at least a section of the closing flap at which the end area is provided is pivotable around a imaginary pivot axis when opening and closing the packaging and wherein a first radius along which the end edge pivots around the pivot axis when opening and closing the packaging is less than a second radius on which a point of the end area pivots that is the furthest away from the pivot axis.

This allows to achieve a particularly good form fit of the end area in relation to the front surface. In particular, a point of the front surface that is the furthest away from the pivot axis may lie on a third radius around the pivot axis, wherein the third radius is greater than the first radius. Further, it is preferred that the third radius is less than or equal to the second radius.

According to a further preferred refinement of the invention the end area is reinforced in a section of the end area.

This refinement allows to provide for the shape-retention of the end area in a particularly simple manner. It is preferred that at least 50%, preferably at least 75%, more preferably 85% and in particular at least 95% of the end area is reinforced. In particular, it is preferred if the end area is reinforced along its full transverse extension. The reinforcement of the end area is preferably achieved by an inexpensive material treating, wherein in particular an embossment of the material or a treatment using a hardening agent are believed to be advantageous. A particularly preferred embodiment will be shown in the exemplary embodiments. There, the reinforcement of the end area is achieved by flipping the packaging material backward in order to obtain a doubled layer.

According to a further preferred refinement of the invention the closing flap is connected to the base body via a first bending area which is configured to lead the closing flap around a front surface of the base body in a curved manner.

This refinement allows that the packaging can be closed very well using the closing flap. It is preferred that the front surface is the same front surface that has been referred to above. However, for particular embodiments it can be preferred that the further front surface is a front surface which lies opposite to the front surface mentioned above. The transition from the base body to the first bending area, the transition from the first bending area to the closing flap and the first bending area are provided without a hinge and without articulation, in particular configured integrally as one piece.

According to a further preferred refinement of the invention the closing flap comprises a second bending area which is configured to lead the closing flap around a further front surface of the base body.

This refinement allows for an improved protection of the base body and the paper contained inside. Preferably, the further front surface is a front surface that lies opposite to the front surface introduced above. This means that the first bending area is led around the front surface which the end area reaches around at least partially, and that the second bending area is led around the further front surface which lies opposite to said front surface. The second bending area is configured without a hinge and without articulation, in particular configured integrally as one piece as a part of the closing flap.

According to a further preferred refinement of the invention the closing flap comprises a first section and a second section, each of their respective transverse extension and longitudinal extension at least substantially corresponding to the transverse extension and the longitudinal extension of the base body.

This refinement can achieve a very good covering of the base body, in particular of the opening of the compartment. In connection with at least one bending area, it is possible to enclose well an item that is arranged at the bottom side of the packaging like a cigarette filter paper block or a lighter by enclosing it with the closing flap.

According to a further preferred refinement of the invention the end area comprises an end edge which extends along the transverse extension and establishes the end of the closing flap, wherein the closing flap can be bent along the bending area or the bending areas such that at least a part of the base body comes to rest on the end edge.

This refinement allows to position the base body relative to a supporting area for the packaging such that the base body is not in contact with the supporting area. If, for example, a liquid is present on the support area, the base body does not come into contact with the liquid. The paper in the packaging is protected from the liquid. It is preferred if the end edge has a length of at least 50%, preferably at least 70%, more preferably at least 80% and in particular at least 90% of the transverse extension of the base body.

According to a further preferred refinement of the invention the closing flap transitions along the longitudinal extension after the first bending area into a first straight section, the first straight section transitions into the second bending area, the second bending area transitions into a second straight section and the second straight section transitions into the end area, so that the closing flap and the base body when viewed from the side have at least substantially the shape of a triangle.

This refinement allows to lift the base body very effectively over the support area on which the packaging rests. This refinement and the technical effect of this refinement will be explained in more detail in reference to an exemplary embodiment.

According to a further preferred refinement of the invention the packaging is made of thick paper, paperboard, cardboard, compressed pulp or glued pulp.

This refinement allows to produce the packaging in an economic and ecological way. In the sense of a good compromise between stability and simplicity of the manufacturing process it is believed to be advantageous if a sheet-like material having a specific weight between 100 $g/m^2$ and 300 $g/m^2$, preferably between 120 $g/m^2$ and 260 $g/m^2$, more preferably between 130 $g/m^2$ and 230 $g/m^2$ and in particular between 140 $g/m^2$ and 200 $g/m^2$ is chosen.

According to a further preferred embodiment of the invention the packaging is embodied integrally as one piece.

This refinement can be manufactured in an inexpensive manner. A preferred example for a corresponding one piece paper pattern is shown in the exemplary embodiments.

According to a further preferred refinement of the invention the closing flap is configured such that in the closed state of the packaging a section of the closing flap adjacent to the end area has a smaller distance to the base body near the end area than a location on the section that is farther away from the end area.

This refinement allows for an improved closing and/or opening of the packaging.

According to a further preferred refinement of the invention the closing flap comprises a section with a material arranged in at least two layers starting from the end area.

This refinement allows in a simple manner for an easy, at least of a section, reinforcement of the closing flap.

According to a further preferred refinement of the invention the closing flap comprises, starting from the end area, a section having a material arranged in at least two layers, the section reaching to the first bending area where it is formed between the first bending area and the base body as a spring area such that it presses the first bending area away from the base body like a spring and thus presses the end area against the front surface.

This refinement improves the closed state of the packaging, because the end area is pressed against the front surface with an additional force so that the end area holds tighter against the front surface.

According to a further preferred refinement of the invention the closing flap comprises at its free end a reinforcement area with an insertion flap, and the closing flap comprises at least one insertion slit which is configured to receive the insertion flap, so that the reinforcement area can be flipped backwards and can be held with its insertion flap in the insertion slit.

This reinforcement allows to have a simple, at least in a section, reinforcement of the closing flap without the use of glue or binder.

According to a further preferred refinement of the invention the compartment is configured for receiving cigarette sheath paper sheets or cigarette filter paper sheets or sticky notes or sticky strips, in particular for a combined receiving of cigarette sheath paper sheets and cigarette filter paper sheets or a combined receiving of sticky notes and sticky strips.

It is understood that the features previously described and those that will be described in the following cannot only be used in the indicated combination but also in combination with other features or in isolation without departing from the scope of the present invention.

BRIEF DESCRIPTION OF THE DRAWINGS

Exemplary embodiments of the invention are shown in the drawings and will be explained in more detail in the following description. The figures show.

DETAILED DESCRIPTION

Figure 1:
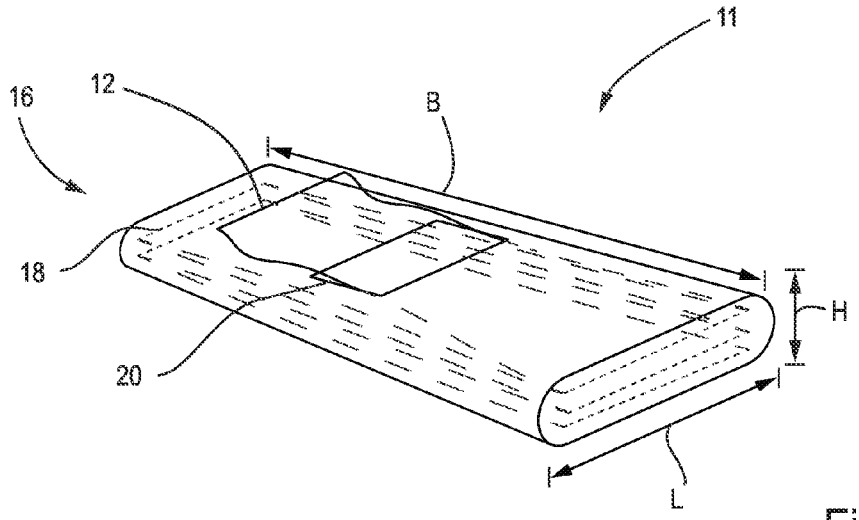
FIG. 1 an exemplary embodiment of a base body of a packaging according to the invention.

FIG. 1 shows a first exemplary embodiment of a base body 11 of a packaging 10 (see FIG. 2) for receiving cigarette sheath paper sheets 12, wherein the packaging 10 comprises a compartment 16 for cigarette sheath paper sheets 12. In order to have a better view, the closing flap 40 (see FIG. 2) is not shown here which in combination with the base body 11 constitutes the packaging 10.

In this embodiment, the cigarette sheath paper sheets 12 are provided as a folded cigarette paper band 18, wherein the paper band 18 is at least twice as long, preferably at least ten times as long and more preferably at least twenty five times as long as the length of a cigarette to be manufactured.

Based on FIG. 1 definitions for the different extensions or directions for an eased understanding when explaining the exemplary embodiments according to the invention are made. A transverse extension B, a longitudinal extension L and a vertical extension H are thus defined. It is understood that these definitions can also be chosen differently and do not limit the scope of protection in view of this chosen nomenclature. An opening 20 of the compartment 16 extends along the longitudinal extension L or transverse to the transverse extension B. In other words, the extension of the opening 20 in the direction of the longitudinal extension L is larger than the extension of the opening 20 in the direction of the transverse extension B.

The base body 11 and the closing flap 40, not shown here, are made of cardboard and is provided as one integral piece as will be explained further down.

Figure 2:
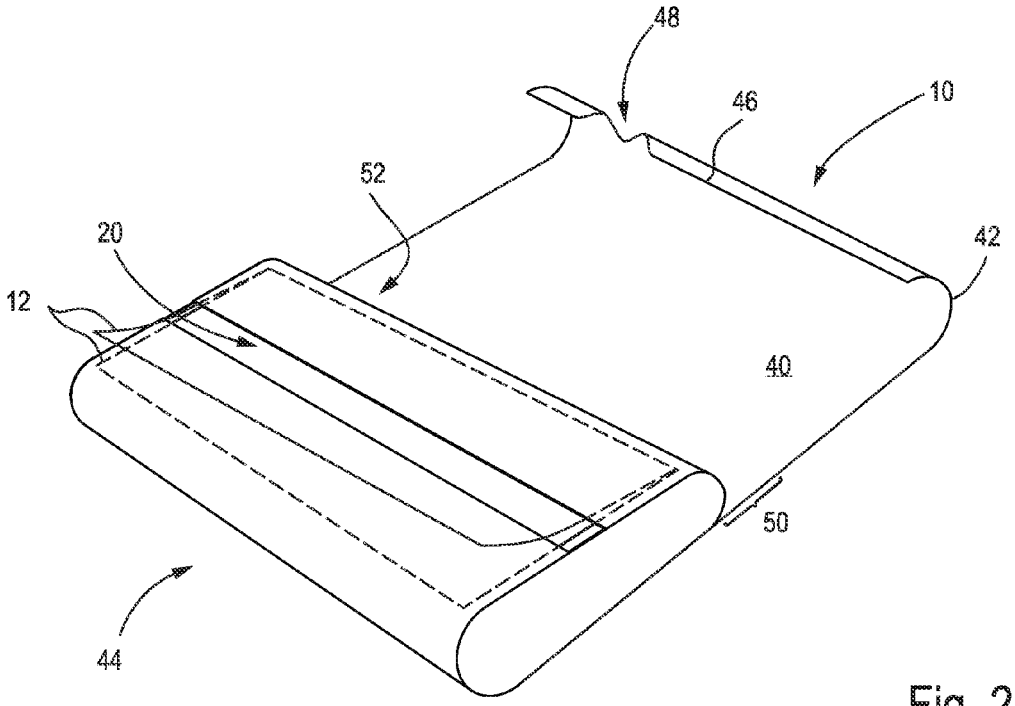
FIG. 2 an exemplary embodiment of a packaging.

FIG. 2 shows a first exemplary embodiment of a packaging 10 for receiving cigarette sheath paper sheets 12. The packaging has the base body 11 as shown in FIG. 1 and a closing flap 40. The closing flap 40 has a substantially shape-retaining bent end area 42 which has such dimensions and is configured such that the end area 42 reaches around a front surface 44 of the base body 11 at least partially in the closed state of the packaging 10.

The closing flap 40 is an extension in the direction of the longitudinal extension L and extends along the full transverse extension B. The end area 42 reaches around the front surface 44 of the packaging 10 in the closed state and thus keeps the closing flap 40 closed. The sheath paper 12 is thus protected.

The opening 20 of the compartment 16 extends along the transverse extension B or transverse to the longitudinal extension L. In other words, the extension of the opening 20 in the direction of the transverse extension B is greater than the extension of the opening 20 in the direction of the longitudinal extension L.

The end area 42 comprises a cross section along a vertical extension H in the shape, at least substantially, of a half ellipse, wherein the height of the cross section is greater than the width of the cross section. The end area 42 comprises an end edge 46. The end area 42 further comprises a recess 48 which is open towards the end edge 46, so that the end area 42 does not reach around the front surface 44 in the area of the recess 48.

The closing flap 40 is connected to the base body 11 via a first bending area 50, which is configured to lead the closing flap 40 around a further front surface of the base body 11 in a bent manner. Since the closing flap 40 is configured as a single closing flap 40, the further front surface 52 around which the closing flap 40 is led, opposite to the front surface 44 which the end area reaches around.

Figure 3:
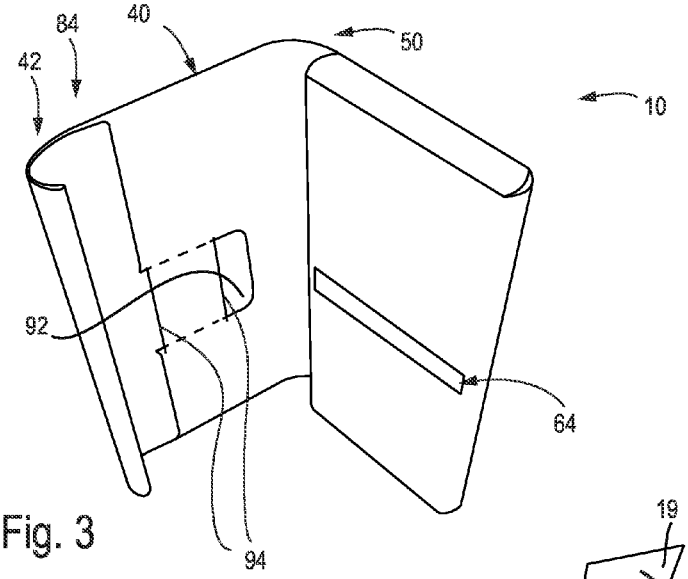
FIG. 3 a further exemplary embodiment of a packaging.

FIG. 3 shows a further exemplary embodiment of a packaging 10 for receiving single cigarette paper sheets 12 or a cigarette paper band 18, wherein the closing flap 40 comprises at its free end a reinforcement area 84 with an insertion flap 92 and wherein the closing flap 40 comprises two insertion slits 94 which are configured to receive the insertion flap 92. The reinforcement area 84 is flipped backward and is held in the insertion slits 94 with its insertion flap 92. Due to the insertion an additional binder can be omitted. The possibility of producing the packaging integrally, i.e. as one piece, is disclosed by the paper pattern shown in FIG. 14.

Figure 4:
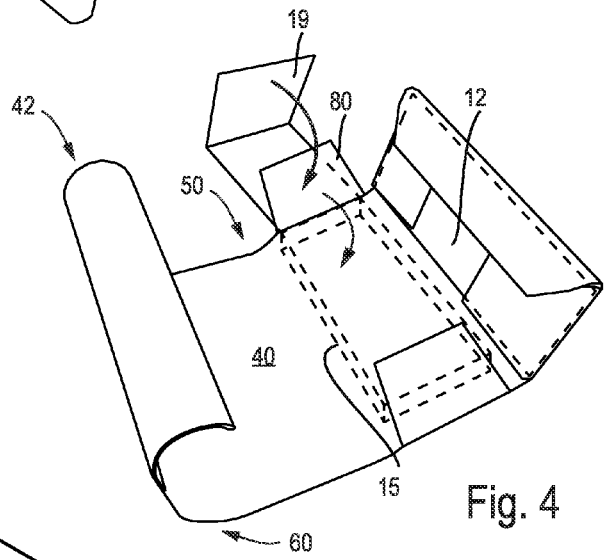
FIG. 4 a further exemplary embodiment of a packaging.

FIG. 4 shows a further exemplary embodiment of a packaging 10, wherein a typical filter paper block 15 is folded into the base body 11 of the packaging 10. Here, a sheet 19 of the filter paper block 15 is folded such that it is hooked behind a side part 80 of the packaging 10.

Figure 5:
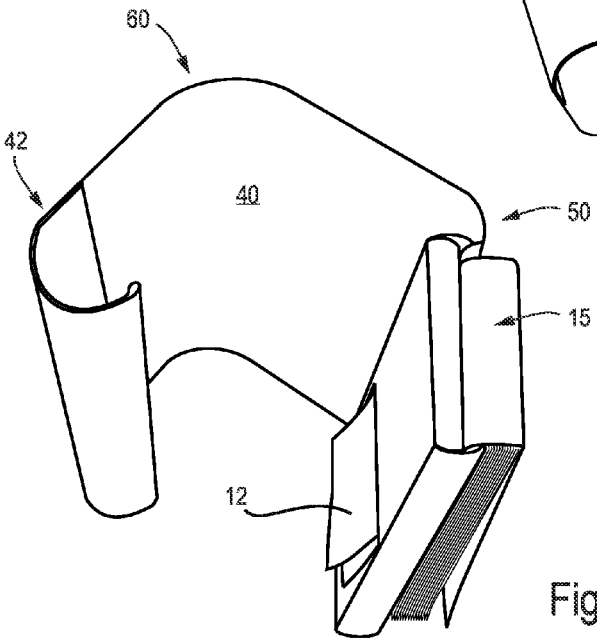
FIG. 5-8 further views of the packaging according to FIG. 4.

FIG. 5 shows the exemplary embodiment of the packaging 10 according to FIG. 4 when the compartment 16 is swung in.

Figure 6:
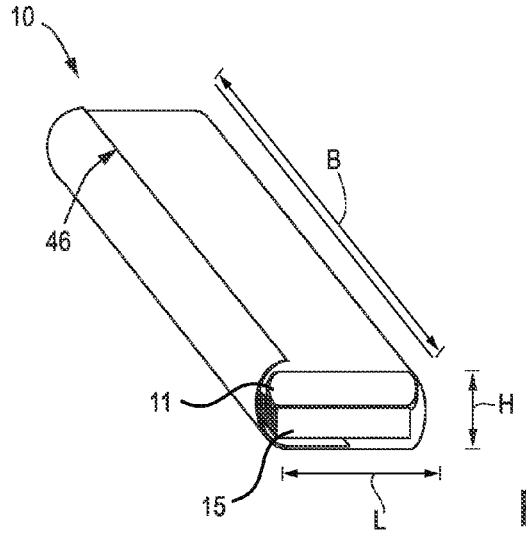

FIG. 6 shows the exemplary embodiment according to FIG. 5 in the closed state.

Figure 7:
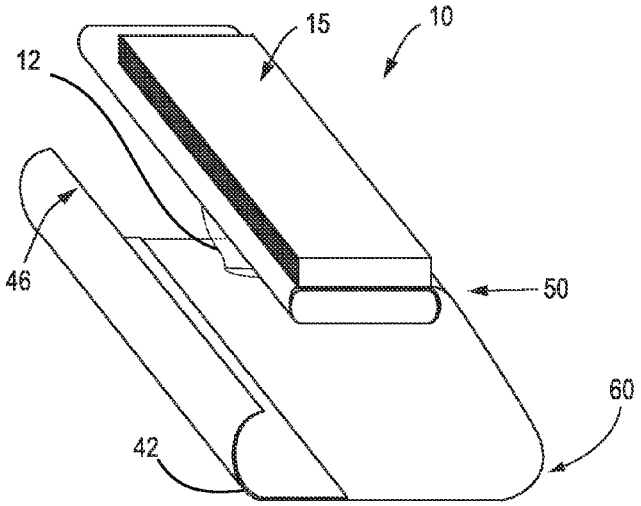

FIG. 7 shows the exemplary embodiment according to FIG. 6 in the opened state from a different perspective.

Figure 8:
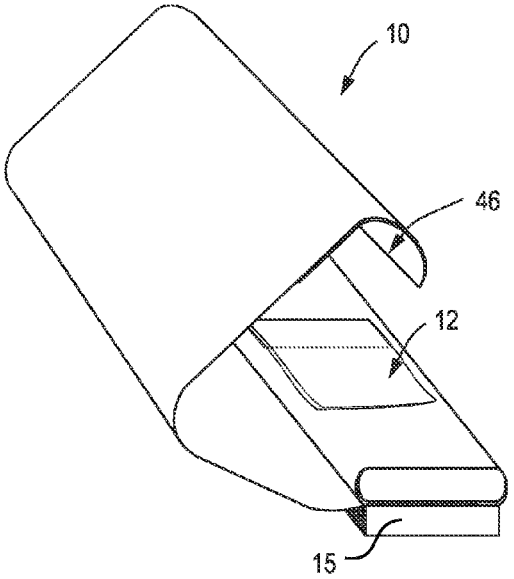

FIG. 8 shows the exemplary embodiment according to FIG. 6 in the opened state from a different perspective.

Figure 9:
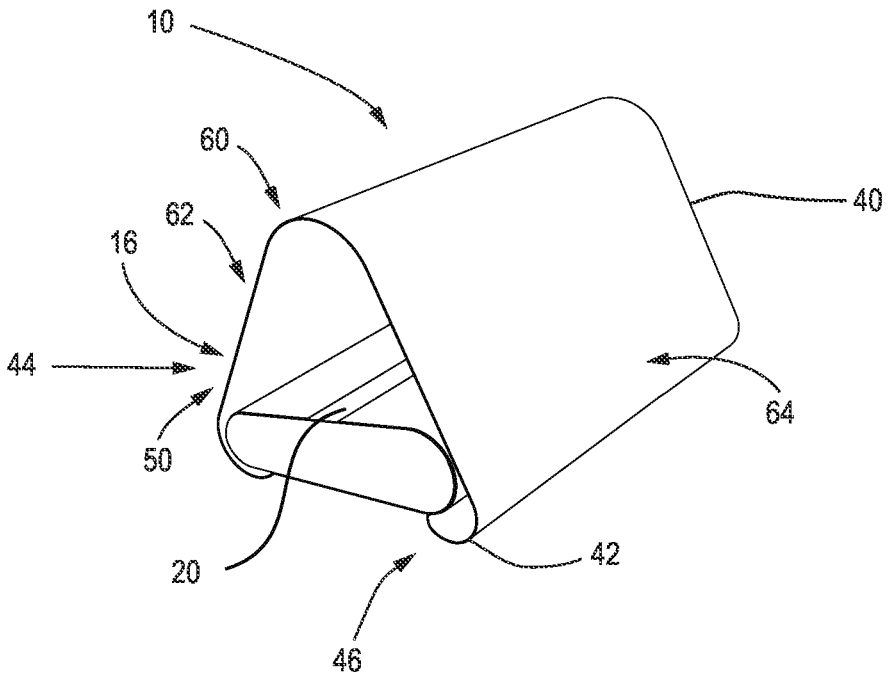
FIG. 9 a further exemplary embodiment of a packaging.

FIG. 9 shows a further exemplary embodiment of a packaging 10. The shown packaging 10 corresponds substantially to the packaging 10 shown in FIG. 2. Here, however, the closing flap 40 is configured as an extended closing flap 40. Thus, the closing flap 40 comprises a second bending area 60, which is configured to lead the closing flap around the further front surface 52 of the base body in a bent manner. The closing flap 40 comprises a first section 62 and a second section 64 which each have a transverse extension B and a longitudinal extension L which correspond at least substantially to the transverse extension B and the longitudinal extension L of the base body.

In particular, the closing flap 40 is therefore configured so that the closing flap 40 along the longitudinal extension L transitions after the first bending area 50 into the first straight section 62, the first straight section 62 transitions into the second bending area 60, the second bending area 60 transitions into the second straight section 64 and the second straight section 64 transitions into the end area 42. The packaging 10 can thus be put down such that the closing flap 40 and the base body 11 show at least substantially the shape of a triangle when viewed from the side.

The end area 42 also has an end edge 46 which runs along the transverse extension B and establishes the end of the closing flap 40. The closing flap can be bent along the bending area 50 (see FIG. 2) or along the bending areas 50, 60 (see FIG. 4) such that at least a part of the base body 11 comes to rest on the end edge 46.

Figure 10:
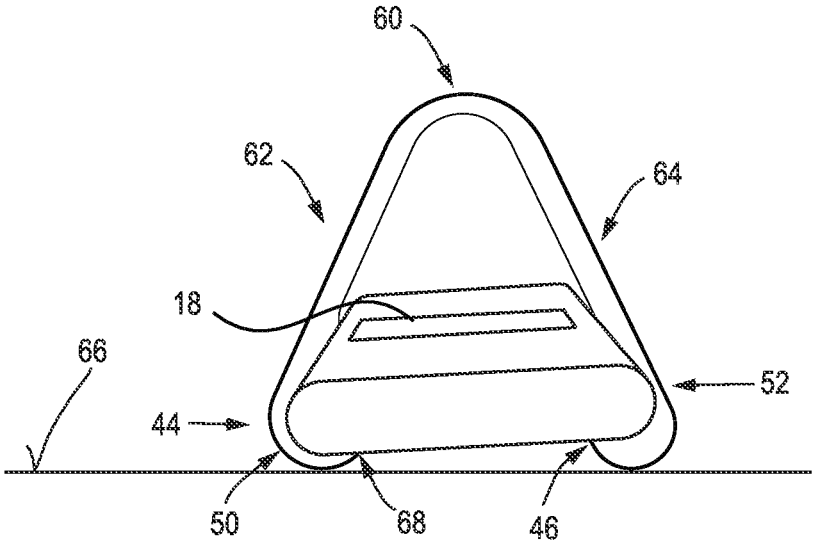
FIG. 10 a further view of the packaging according to FIG. 9.

FIG. 10 shows the second exemplary embodiment according to FIG. 4 in a perspective view from the side. It can be seen that the base body 11 is raised above a support surface 66 of the packaging 10. The side with the front surface 44 is raised because the first bending area 50 maintains its round shape also in the partially opened state due to the inherent stability of the material.

In this context it is advantageous if an abutment edge 68, which runs in a direction of the transverse extension B and which connects the closing flap 40 to the base body 11, sits at a distance from the front surface 44 along the longitudinal extension L. The side with the further front surface 52 is raised, because the base body 11 rests on the end edge 46. Should a liquid flow onto the support area 66, the base body 11 is protected from moisture.

Figure 11A:
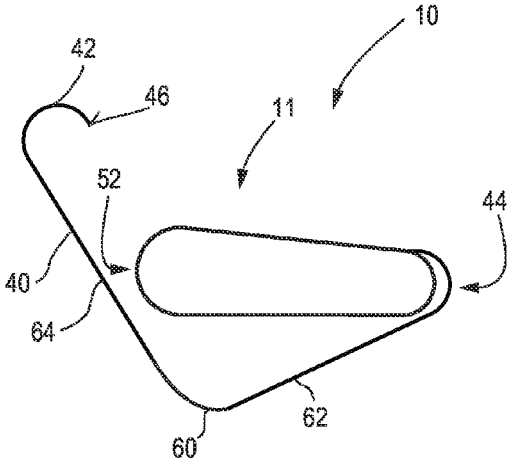
FIG. 11*a*-11*e* a process of closing a packaging.

FIG. 11*a* shows the packaging 10 according to FIG. 2 in a view from the side.

In FIGS. 11*b* to 11*e* it is shown that the closing flap 40 with the end area 42 is configured such that the end area can only be pushed over the front surface 44 undergoing a slight deflection against an elastic counter force when opening or closing the packaging 10.

Figure 11B:
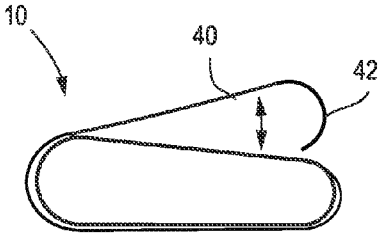

FIG. 11*b* shows the state of the packaging 10 when the closing flap 70 is led relatively loosely around the base body 11. It is noted that not all reference numerals that have been previously introduced are repeated in order to not obscure the disclosure. However, all reference numerals remain valid like they have been introduced and used before. Further, it is noted that while FIGS. 11*b* to 11*e* show the process of closing, they also disclose—when reversing the sequence of the figures—the process of opening the packaging 10.

Figure 11C:
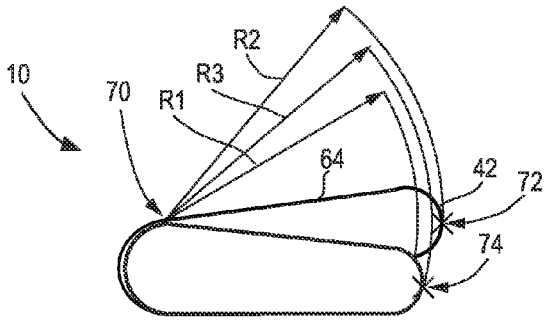

FIG. 11*c* shows that the second straight section 64 pivots, at least substantially, around a imaginary pivot axis 70 during opening and closing of the packaging 10. The closing flap 40 is now pulled somewhat tighter against the base body 11. It can be seen that in particular the bending in the area of the front surface 44 lies tight.

When opening and closing the packaging, the end edge 46 moves on a first radius R1 around the pivot axis 70. Further, point 72 of the end area 42, which lies the farthest away from the pivot axis 70, moves on a second radius R2 around the pivot axis. Finally, a point 74 of the front surface 44, which lies the farthest away from the pivot axis 70, lies on a radius R3.

Figure 11D:
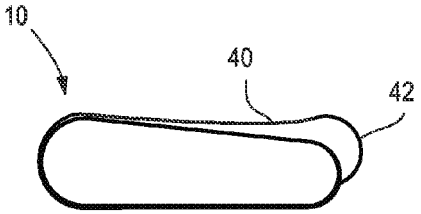

It is shown how the end area 42 with the end edge 46 glides onto the front surface 44 during closing. FIG. 11*d* shows that the closing flap 40 is slightly deflected in an area adjacent to the end area 42. This allows for the end area 42 to further glide over the front surface 44. The end edge 46 moves beyond the point 74 on the front surface 44.

In general it is also possible that the end area 42 undergoes a slight deflection. During practical experiments, however, it was found to be beneficial if the bending takes place substantially in the closing flap 40, here in the second straight section 64. The closing flap 40 is now pulled against the base body 11.

Figure 11E:
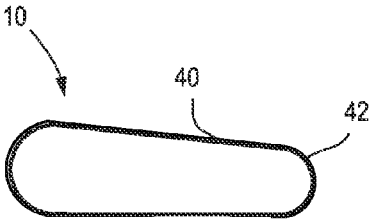

FIG. 11*e* shows the situation when the closing flap is closed. The elastic counter force which was created by the bending of the closing flap 40 (perhaps also by the end area 42) now provides for bringing the closing flap 40 with the end area 42 back into its original shape. The packaging 10 is now closed and can only be opened again by applying a force. The closing flap 40 relaxes slightly and preferably pulls the end area 42 against the front surface 44.

Figure 12A:
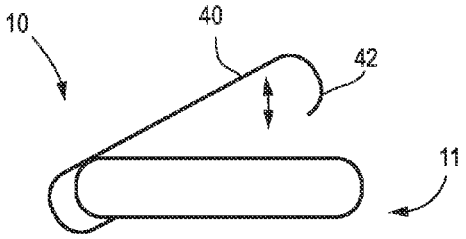
FIG. 12*a*-12*d* a further process of closing a packaging.

FIG. 12*a* shows again the packaging 10 according to FIG. 4 in a view from the side. In the following disclosed alternative process of closing an advantage is achieved in that the packaging 10 is resilient and has a elongate closing flap 40 instead of a hinge. Initially, the basic state is shown. It is pointed out that the process of closing shown in FIGS. 12*a*-12*d* can also be applied to the packaging 10 shown in FIG. 2. It is further pointed out that the process of closing shown in FIGS. 11*a*-11*e* can also be applied to the packaging 10 according to FIG. 4.

Figure 12B:
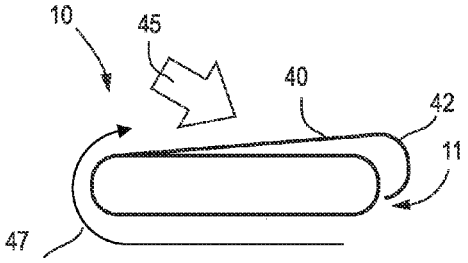
Figure 12C:
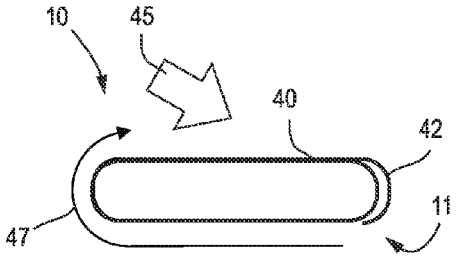
Figure 12D:
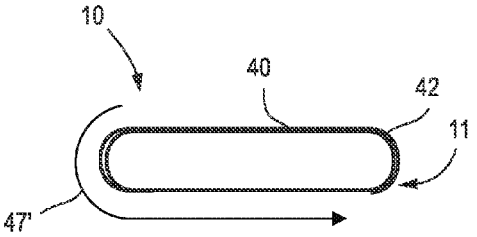

FIG. 12*b* shows how the closing flap 40 tightens around the base body 11 due to the pressure force 45 as indicated by the arrow 47. The end area 42 therefore moves downwards as well as to the right when referring to the orientation shown in the drawing. FIG. 12*c* shows how the movement progresses. When the closing flap 40 finally reaches its end position, see FIG. 12*d*, the pressure force 45 ceases due to the fact that the user does not press the closing flap 40 anymore. The closing flap 40 then moves in the direction of the arrow 47' back into the relaxed position.

The movement of the closing flap 40 is substantially achieved in that the closing flap 40 tightens against the base body (arrow 47) under the influence of the pressure force 45 and relaxes (arrow 47') when the pressure force 45 ceases. Also in this context it is pointed out that FIGS. 12*a* to 12*d* show the process of closing, however, at the same time—when viewing the sequence in reverse—disclose the process of opening the packaging 10.

In FIGS. 13*a* to 13*e* further exemplary embodiments of packagings 10 are shown where the respective front surface 44 and end area 42 are configured differently. Each of said figures shows in a first representation the respective packaging 10 in a side view and in a second representation a magnified view of the end area 42 of the closing flap 40.

Figure 13A:
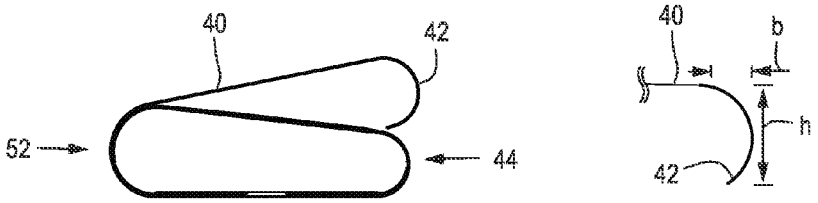
FIG. 13*a*-13*e* side views of further exemplary embodiments of the packaging.

The packaging 10 shown in FIG. 13*a* is the exemplary embodiment known from FIG. 4. The cross section along a vertical extension H of the closing flap has substantially the shape of a half circle, wherein the height h of the cross section is greater than the width b of the cross section.

Figure 13B:
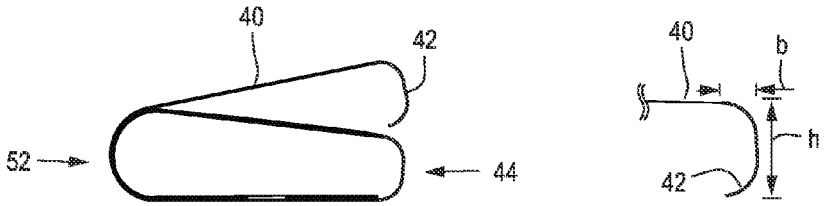
Figure 13C:
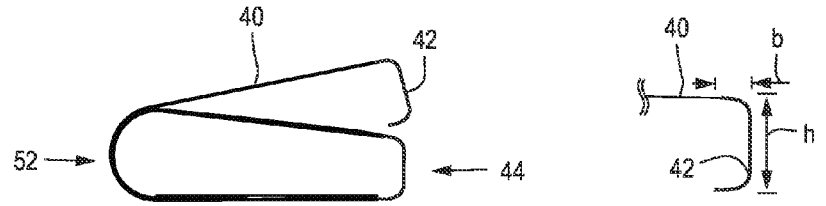
Figure 13D:
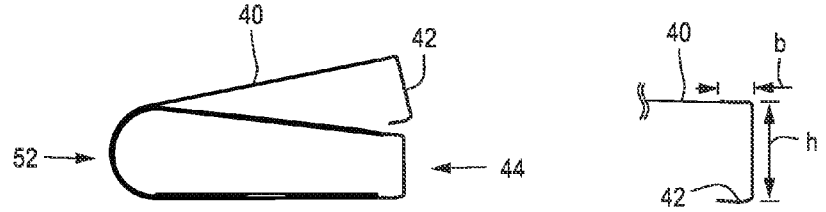

FIGS. 13*b* to 13*d* show exemplary embodiments where the cross section has substantially the shape of a U. The exemplary embodiments differ in that the curves of the U become less and less pronounced.

In FIGS. 13*a* to 13*d* the front surface 44 was chosen such that it corresponds to the shape of the end area 42 and vice versa. This allows for a good form fit. The exemplary embodiments that have the curves of the U less pronounced are believed to be less preferred, since the effect of gliding onto, as it is shown in FIGS. 11*b* to 11*e*, is more difficult for such shape. However, depending on the design goal, such embodiment can be preferred if a particularly good form fit is desired. Further it can be advantageous if the contour of the front surface 44 is designed asymmetrically, so that the end area 42 glides over a round surface during closing, but has to be lifted over an edge for opening.

Figure 13E:
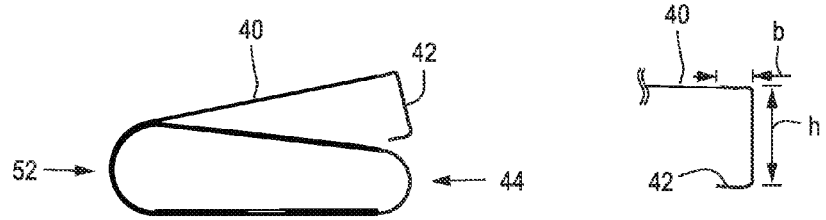

Finally it is shown in FIG. 13*e* that the shape of the end area 42 does not have to correspond to the contour of the front surface 44. Such embodiment is encompassed by the invention, even though it is believed today to be less preferred.

Figure 14:
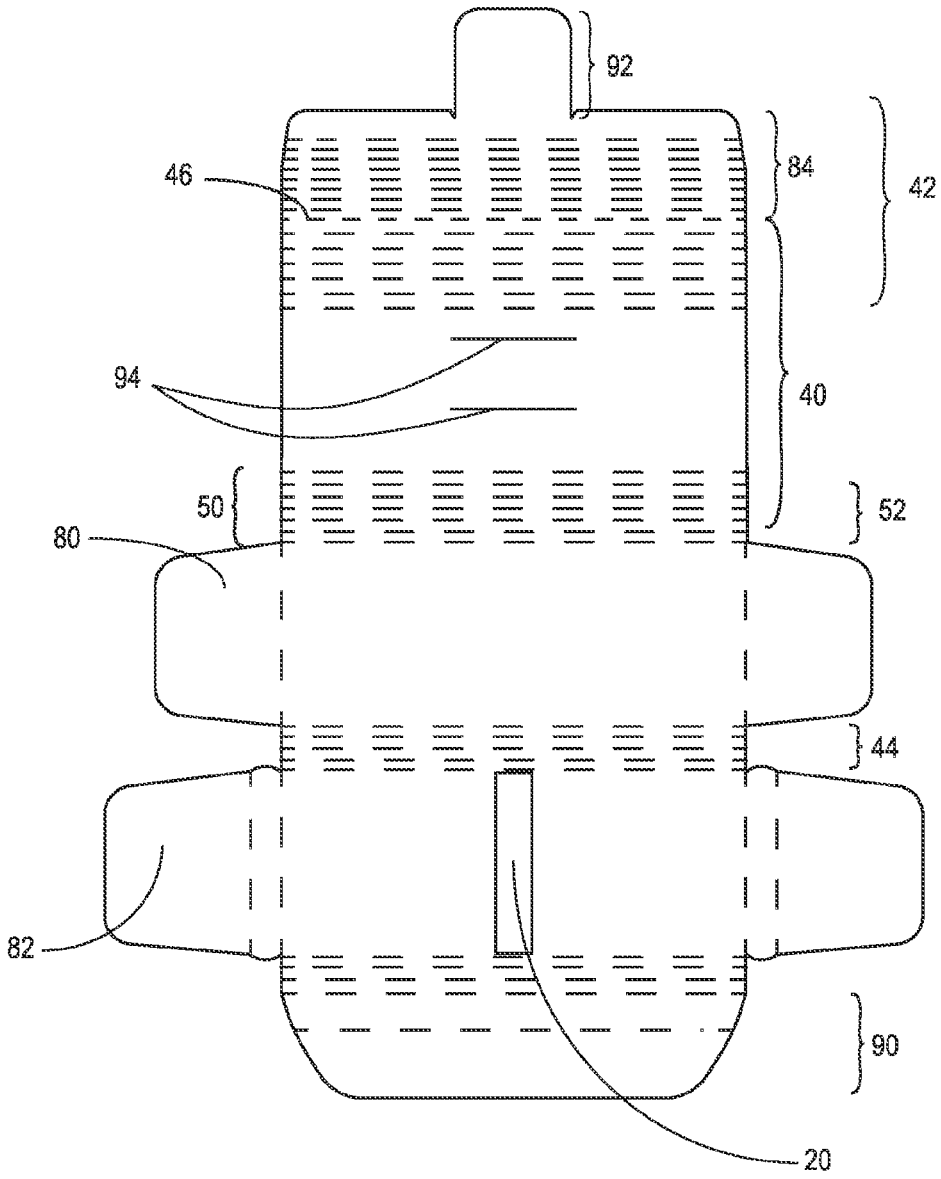
FIG. 14 a paper pattern that allows for an integral embodiment of the packaging as one piece.

FIG. 14 shows a paper pattern that allows for an integral manufacture of the packaging 10. The paper pattern is bent along the parallel dashed lines, and the side parts 80 and 82 are inserted. The area 84 is used as a material reinforcement for the end area 42. It is flipped back and thereby doubles the material thickness in the end area 42. Other kinds of reinforcement can also be chosen.

The closing flap 40 comprises at its free end a reinforcement area 84 with an insertion flap 92. The closing flap 40 further comprises at least one insertion slit 94, here two insertion slits 94, which are configured to receive the insertion flap 92, so that the reinforcement area 84 can be flipped back and can be held in its insertion slit 94 or in its insertion slits 94 with its insertion flap 92.

The paper pattern offers a good possibility to implement the packaging 10 according to the invention. When producing a real-life model, disclosed advantages of the invention can be understood well. Further, based on such model, further advantages and special characteristics of the packaging 10 according to the present invention are disclosed.

Figure 15A:
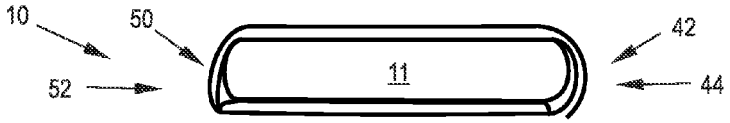
FIG. 15*a*-15*k* side views of further exemplary embodiments of the packaging.
Figure 15B:
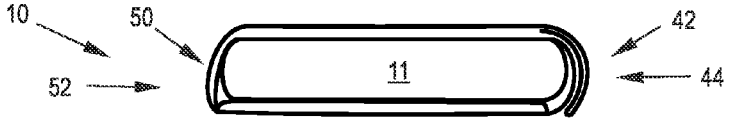

FIG. 15*a* shows in a side view an exemplary embodiment of the packaging 10, where the closing flap 40 is manufactured in one layer in full.

FIGS. 15*b*-15*g* show exemplary embodiments of the packaging 10, where the closing flap 40 starting from the end area 42 comprises a section that comprises at least two layers. The section is preferably embodied as one integral piece. The dashed line in FIG. 15*g* indicates that the section can extend over and beyond the bending area 50.

FIGS. 15*h*-15*k* show exemplary embodiments of the packaging 10, wherein the closing flap 40 starting from the end area 42 comprises a section with a material in at least two layers, which leads to the first bending area 50 and which is configured between the first bending area 50 and the base body 11 as a spring area 77, so that it pushes the first bending area 50 away from the base body 11 in the manner of a spring and thus pushes the end area 42 against the front surface 44.

Figure 16A:
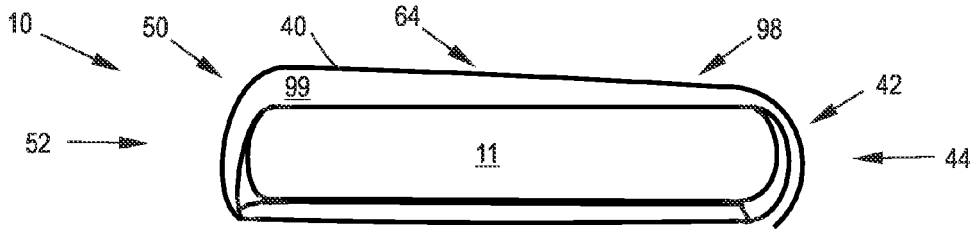
FIG. 16*a*-16*e* side views of further exemplary embodiments of the packaging.

FIG. 16*a* shows a further exemplary embodiment of a packaging 10 wherein the closing flap 40 is configured such that in the closed state of the packaging 10 a section 64 of the closing flap 40, which is adjacent to the end area 42, has in the vicinity of the end area 42, see arrow 98, a smaller distance to the base body 11 than at a location 99 of the section 64 which is farther away from the end area 42. In this exemplary embodiment the closing flap 40 is flipped over the base body 11.

Figure 16B:
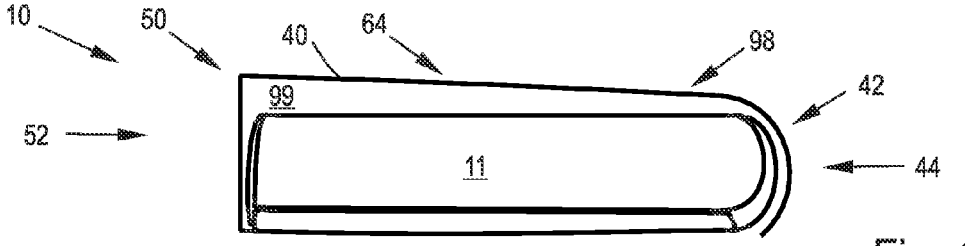

FIG. 16*b* shows a further exemplary embodiment of a packaging 10 which corresponds to the exemplary embodiment according to FIG. 15*a* with the exception of the bending area 50.

Figure 16C:
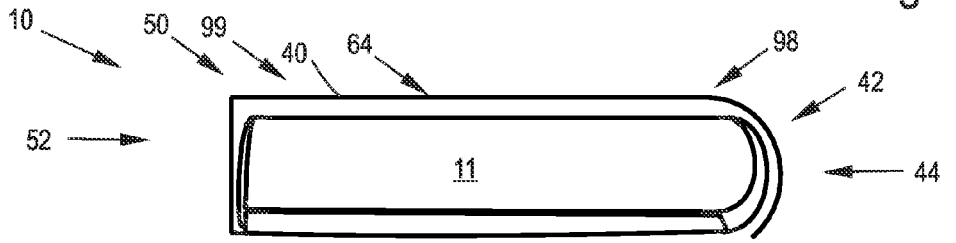

FIG. 16*c* shows a further exemplary embodiment of a packaging 10 where in the closed state of the packaging 10 a section 64 of the closing flap 40, which is adjacent to the end area 42, has in the vicinity of the end area 42, see arrow 98, at least substantially the same distance to the base body 11 as at a location 99 of the section 64 that is farther away from the end area 42.

Figure 15C:
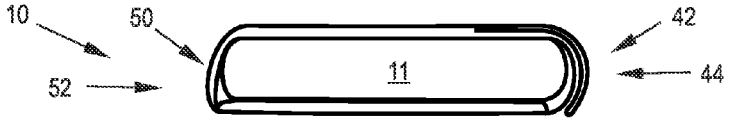
Figure 16D:
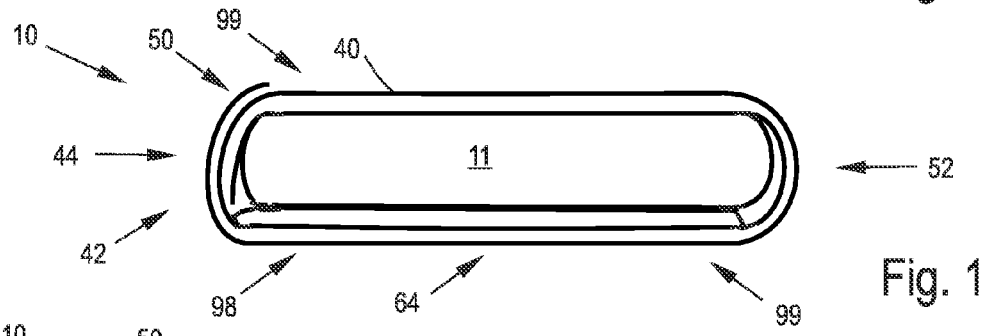

FIG. 16*d* shows a further exemplary embodiment of a packaging 10, which corresponds to the exemplary embodiment according to FIG. 15*c* with the exception that the closing flap 40 is flapped twice over the base body 11.

Figure 15D:
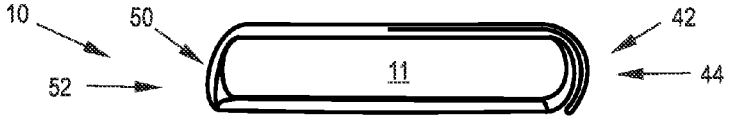
Figure 15E:
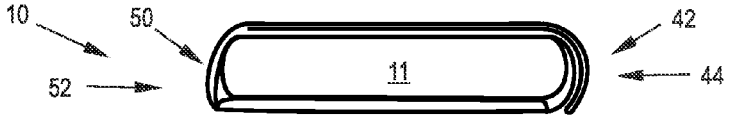
Figure 15F:
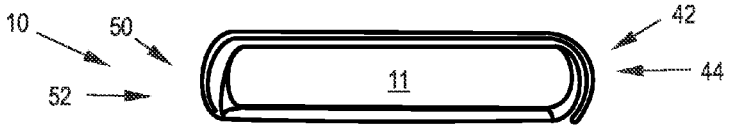
Figure 15G:
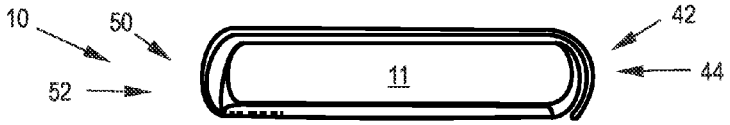
Figure 15H:
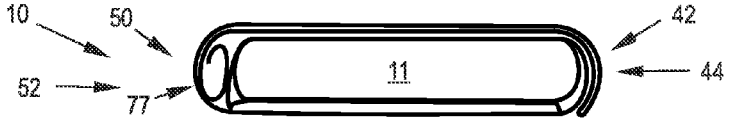
Figure 15I:
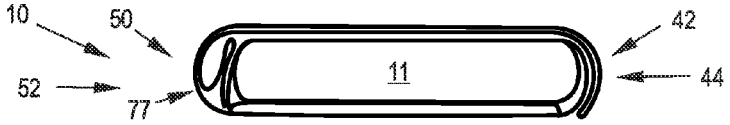
Figure 15J:
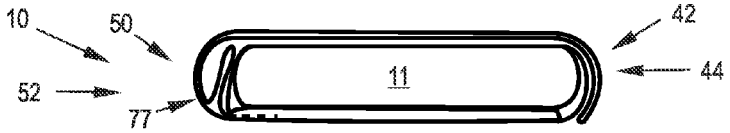
Figure 15K:
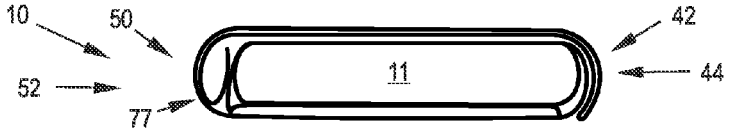
Figure 16E:
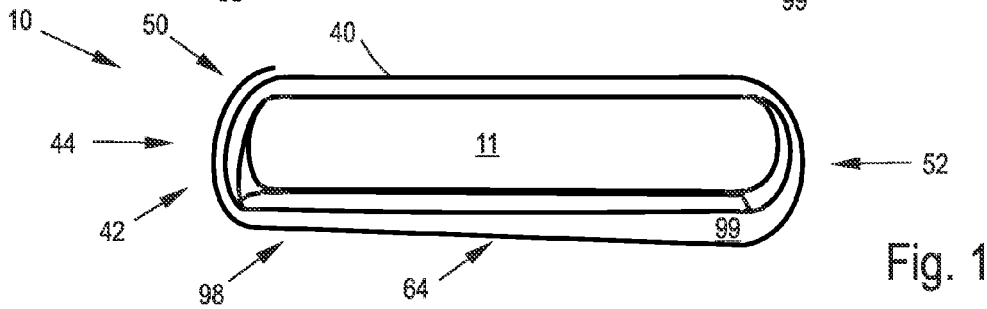

FIG. 16*e* shows a further embodiment of a packaging 10, which corresponds to the exemplary embodiment according to FIG. 15*d*, with the exception that the closing flap 40 is configured such that in the closed state of the packaging 10 a section 64 of the closing flap 40, which is adjacent to the end area 42, has in the vicinity of the end area 42, see arrow 98, a smaller distance to the base body 11 as at a location 99 of the section 64 that is farther away from the end area 42.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

What is claimed is:

1. A packaging comprising a base body, that comprises a compartment, and a closing flap formed as a single unitary piece with the base body, wherein; the base body has a substantially planar structured bottom portion, the closing flap has a substantially planar structured top portion, the closing flap comprises a substantially shape-retaining, bent end area that is dimensioned and configured for reaching at least partially around a first front surface of the base body in the closed state of the packaging, and wherein the closing flap is configured with the bent end area such that when opening or closing the packaging the bent end area can be pushed or lifted over the first front surface against an elastic counter force by tensioning the closing flap in a direction of a longitudinal extension around the base body, and/or wherein the closing flap is configured with the bent end area such that when opening or closing the packaging the bent end area can be pushed over the first front surface undergoing a slight deflection; and wherein the closing flap comprises a reinforced section with a material arranged in at least two layers, starting from the bent end area, and reaching at least across a part of or all of the closing flap.

2. The packaging according to claim 1, wherein the packaging comprises exactly one compartment.

3. The packaging according to claim 1, wherein the bent end area comprises along a longitudinal extension of the closing flap at least substantially a shape selected from the group consisting of a shape of a U, a shape of a half circle and a shape of a half ellipse, wherein the height of the cross section is greater than the width of the cross section.

4. The packaging according to claim 1, wherein the bent end area is reinforced in at least a section of the bent end area.

5. The packaging according to claim 3, wherein the bent end area is reinforced in at least a section of the bent end area.

6. The packaging according to claim 1, wherein the closing flap is connected to the base body via a first bending area which leads the closing flap in a curved manner around the first front surface or a further front surface of the base body.

7. The packaging according to claim 3, wherein the closing flap is connected to the base body via a first bending area which leads the closing flap in a curved manner around the first front surface or a further front surface of the base body.

8. The packaging according to claim 4, wherein the closing flap is connected to the base body via a first bending area which leads the closing flap in a curved manner around the first front surface or a further front surface of the base body.

9. The packaging according to claim 6, wherein the closing flap comprises a second bending area which leads the closing flap in a curved manner around the further front surface of the base body.

10. The packaging according to claim 1, wherein the closing flap is configured such that in the closed state of the packaging a section of the closing flap adjacent to the end area has a smaller distance to the base body near the bent end area than at a location on the section that is farther away from the bent end area.

11. The packaging according to claim 6, wherein the closing flap is configured such that in the closed state of the packaging a section of the closing flap adjacent to the end area has a smaller distance to the base body near the bent end area than at a location on the section that is farther away from the bent end area.

12. The packaging according to claim 9, wherein the closing flap is configured such that in the closed state of the packaging a section of the closing flap adjacent to the end area has a smaller distance to the base body near the bent end area than at a location on the section that is farther away from the bent end area.

13. The packaging according to claim 6, wherein the closing flap comprises, starting from the bent end area, a section having a material arranged in at least two layers, the section reaching to the first bending area where the section is formed between the first bending area and the base body as a spring area such that the section presses the first bending area away from the base body like a spring and thus presses the end area against the front surface.

14. The packaging according to claim 9, wherein the closing flap comprises, starting from the bent end area, a section having a material arranged in at least two layers, the section reaching to the first bending area where the section is formed between the first bending area and the base body as a spring area such that the section presses the first bending area away from the base body like a spring and thus presses the end area against the front surface.

15. The packaging according to claim 1, wherein the closing flap comprises at a free end a reinforcement area with an insertion flap and wherein the closing flap comprises at least one insertion slit for receiving the insertion flap, so that the reinforcement area can be flipped backwards and can be held with said insertion flap in the insertion slit.

16. The packaging according to claim 13, wherein the closing flap comprises at a free end a reinforcement area with an insertion flap and wherein the closing flap comprises at least one insertion slit for receiving the insertion flap, so that the reinforcement area can be flipped backwards and can be held with said insertion flap in the insertion slit.

17. The packaging according to claim 14, wherein the closing flap comprises at a free end a reinforcement area with an insertion flap and wherein the closing flap comprises at least one insertion slit for receiving the insertion flap, so that the reinforcement area can be flipped backwards and can be held with said insertion flap in the insertion slit.

18. The packaging according to claim 1, wherein the compartment receives one selected from the group consisting of cigarette sheath paper sheets, cigarette filter paper sheets, sticky notes and sticky strips.

19. The packaging according to claim 13, wherein the compartment receives one selected from the group consisting of cigarette sheath paper sheets, cigarette filter paper sheets, sticky notes and sticky strips.

20. The packaging according to claim 1, wherein the packaging is made of a material selected from the group consisting of thick paper, paperboard, cardboard, compressed pulp and glued pulp.

21. The packaging according to claim 18, wherein the compartment receives one of a combined cigarette sheath paper sheets and cigarette filter paper sheets or a combined sticky notes and sticky strips.

22. The packaging according to claim 19, wherein the compartment receives one of a combined cigarette sheath paper sheets and cigarette filter paper sheets or a combined sticky notes and sticky strips.

* * * * *